US005627515A

United States Patent [19]

Anderson

[11] Patent Number: 5,627,515

[45] Date of Patent: May 6, 1997

[54] ALARM SYSTEM WITH MULTIPLE COOPERATING SENSORS

[75] Inventor: Donald D. Anderson, Easton, Conn.

[73] Assignee: Pittway Corporation, Chicago, Ill.

[21] Appl. No.: 396,179

[22] Filed: Feb. 24, 1995

[51] Int. Cl.[6] ..... G08B 23/00

[52] U.S. Cl. ..... 340/517; 340/501; 340/505; 340/506; 340/522; 340/524; 340/525; 340/587

[58] Field of Search ..... 340/517, 501, 340/505, 506, 522, 524, 525, 587

[56] References Cited

U.S. PATENT DOCUMENTS

| | | | |
|---|---|---|---|
| 4,388,616 | 6/1983 | Machida | 340/587 |
| 4,525,700 | 6/1985 | Kimura et al. | 340/518 |
| 4,556,873 | 12/1985 | Yamada et al. | 340/630 |
| 4,639,598 | 1/1987 | Kern et al. | 250/339 |
| 4,644,331 | 2/1987 | Matsushita et al. | 340/587 |
| 4,667,193 | 5/1987 | Cotie et al. | 340/825.08 |
| 4,668,939 | 5/1987 | Kimura et al. | 340/521 |
| 4,725,820 | 2/1988 | Kimura | 340/522 |
| 4,727,359 | 2/1988 | Yuchi et al. | 340/518 |
| 4,745,399 | 5/1988 | Kimura | 340/521 |
| 4,749,986 | 6/1988 | Otani et al. | 340/587 |
| 4,749,987 | 6/1988 | Ishii | 340/587 |
| 4,785,283 | 11/1988 | Yuchi | 340/501 |
| 4,796,205 | 1/1989 | Ishii et al. | 364/550 |
| 4,803,469 | 2/1989 | Matsushita | 340/577 |
| 4,818,994 | 4/1989 | Orth et al. | 340/870.21 |
| 4,831,361 | 5/1989 | Kimura | 340/506 |
| 4,871,999 | 10/1989 | Ishii et al. | 340/587 |
| 4,881,060 | 11/1989 | Keen et al. | 340/511 |
| 4,884,222 | 11/1989 | Nagashima et al. | 340/550 |
| 4,916,432 | 4/1990 | Tice et al. | 340/518 |
| 4,922,230 | 5/1990 | Ohtani et al. | 340/577 |
| 4,924,417 | 5/1990 | Yuasa | 364/550 |
| 4,972,178 | 11/1990 | Suzuki | 340/577 |
| 4,975,684 | 12/1990 | Guttinger et al. | 340/587 |
| 4,977,527 | 12/1990 | Shaw et al. | 340/630 |
| 5,005,003 | 4/1991 | Ryser et al. | 340/587 |
| 5,105,371 | 4/1992 | Shaw et al. | 364/550 |
| 5,138,562 | 8/1992 | Shaw et al. | 364/550 |
| 5,155,468 | 10/1992 | Stanley et al. | 340/501 |
| 5,168,262 | 12/1992 | Okayama | 340/523 |
| 5,281,951 | 1/1994 | Okayama | 340/511 |

FOREIGN PATENT DOCUMENTS

| | | |
|---|---|---|
| 61-98498 | 4/1993 | Japan . |
| 59-157789 | 6/1994 | Japan . |
| 59-172093 | 6/1994 | Japan . |

*Primary Examiner*—Jeffery Hofsass
*Assistant Examiner*—Daryl C. Pope
*Attorney, Agent, or Firm*—Dressler, Goldsmith, Milnamow & Katz, Ltd.

[57] ABSTRACT

A fire alarm system includes a control unit which communicates with a plurality of spaced apart smoke detectors by a bi-directional communications link. The smoke detectors are separate from one another, and spaced apart, and are associated together in different, overlapping groups. Each group of detectors is physically arranged with the members of the group adjacent to one another in a relatively localized area. Signals from the detectors are transmitted to the control element for processing. The control element squares each of the signals for a given group, sums those signals and then takes a square root. The resultant processed value is associated with a selected one of the detectors of the group. Similar processing takes place for each of the groups. As a result of the processing, each of the detectors has associated therewith a processed smoke value which takes into account not only values received from the associated detector, but also values received from one or more adjacent detectors in a group. The processed signal values can then be compared to an alarm threshold to determine whether or not a fire condition is present.

13 Claims, 3 Drawing Sheets

ALARM SYSTEM WITH MULTIPLE COOPERATING SENSORS

FIELD OF THE INVENTION

The invention pertains to systems for determining the absence of a selected condition based on a plurality of data inputs. More particularly, the invention pertains to fire detection systems which receive inputs from a number of detectors or sensors which are spaced apart from but are adjacent to one another in one or more regions of interest.

BACKGROUND OF THE INVENTION

In fire alarm systems commonly used today, a central control panel communicates with many individual smoke sensors, reads their output level of smoke measurement, and uses software algorithms to determine if an alarm condition exists at any of the smoke sensors. The control panel may also incorporate programmed algorithms for example, to compensate for drift due to dust accumulation or other environmental factors.

The design of the detectors and the design of the algorithm are important factors in being able to quickly detect a true fire, while being able to resistant false fire indications. However, systems typically in use today do not take the states of other nearby detectors into account in making an alarm decision.

Another system less commonly used provides special multiple technology fire sensors. These special sensors include at least two different types of smoke, heat, or fire sensor technology in the same physical device.

A microcomputer is incorporated into each sensor. The microcomputer processes the multiple signals from the different types of sensors and provides a single signal to the control panel, which is a better measurement of fire than a single sensor. These multiple technology sensors typically do not take the measurements from other nearby sensors into account when making the alarm decision at one sensor location. The multiple sensors are also more expensive to manufacture than single sensors.

Thus, there continues to be a need for alarm systems which can cost-effectively and quickly determine the existence of an alarm condition while being resistant to false alarms. Preferably such systems could use single sensor-type detectors.

SUMMARY OF THE INVENTION

A control panel communicates with a large number of smoke or fire sensors. Each of said sensors reports an ambient condition value to the control panel.

The control panel can include programmable methods for filtering and adjusting the values from each sensor. In this way, long term drift of the sensed value or values, caused by dirt accumulation, or very short term changes, caused by electrical interference, are eliminated. The control panel thereby determines a compensated value for each sensor. This value, at sufficiently high levels, is indicative of a fire at or near the sensor.

In the system as described, the installer is required to assign or enter an address number for each sensor. The installer is also required to assign addresses sequentially with regard to the physical locations of the sensors. In this way all sensors located in a single room or area will have numerically sequential addresses.

After measuring, compensating and filtering the value or values over time for a particular sensor, the control panel will square the processed value. Similarly, the values of sensors which are physically adjacent to the said particular sensor are processed and squared.

The squared readings of the particular sensor and the nearby sensors are summed (added arithmetically). A square root of the sum is calculated. The resultant value is the room-mean-square (RMS) of the readings.

The RMS value is now treated as if it was the sole reading of the particular sensor, and an alarm is sounded if the level exceeds a predetermined alarm threshold. For example, if a room has three sensors, and a fire exists with homogeneous smoke in the room, an alarm could be sounded for the middle address sensor at 58% of the level needed if a processed value from only one sensor was used. The combining of multiple sensor readings to reach an alarm decision is called a "cooperative" system.

The RMS method, which squares before adding, tends to reduce the effect of small readings and increase the effect of adjacent large readings. In this way it resists the effect of minor noise perturbations.

For example, if a detector measurement is 90% of the alarm threshold, and has two adjacent detectors both at 30% of alarm, the RMS is under 100%. If the same 90% detector has one adjacent detector at 45%, and one at 0%, its RMS is over 100%.

Further, the use of cooperative sensors after dirt accumulation compensation (low frequency) and electromagnetic (high frequency) noise filtering provides resistance to mid-frequency noise effects. For example, the random occurrence of a fiber or insect in a smoke chamber is less likely to occur in two adjacent sensors at once. Therefore the system as described should be comparable to non-cooperative sensor systems in its ability to resist false alarm phenomena.

Alternately, a system which embodies the invention could be adjusted so that each sensor is less sensitive than normal, yet the cooperative method described above recovers this lost sensitivity. This results in a system which continues to be sensitive to true fires, yet provides improved false alarm resistance.

Because the system compares adjacent devices, there is no need for the installer to define special groupings of sensors. If a room has more than one sensor, the ability of this system to detect fires in that room should improve. If a room has only one detector, it may not receive any benefit, but will receive no degradation. This installation simplicity will reduce installation cost and errors.

The system may also be used to provide multiple sensing technologies in one area. For example a photoelectric smoke detector, an ionization smoke detector, and a thermal detector could be placed in a single room. This will allow a cooperative system to obtain the benefits of different technologies in the one area and to exceed the performance of any one of these single technologies.

These and other aspects and attributes of the present invention will be discussed with reference to the following drawings and accompanying specification.

DETAILED DESCRIPTION OF THE PREFERRED EMBODIMENT

Figure 1:
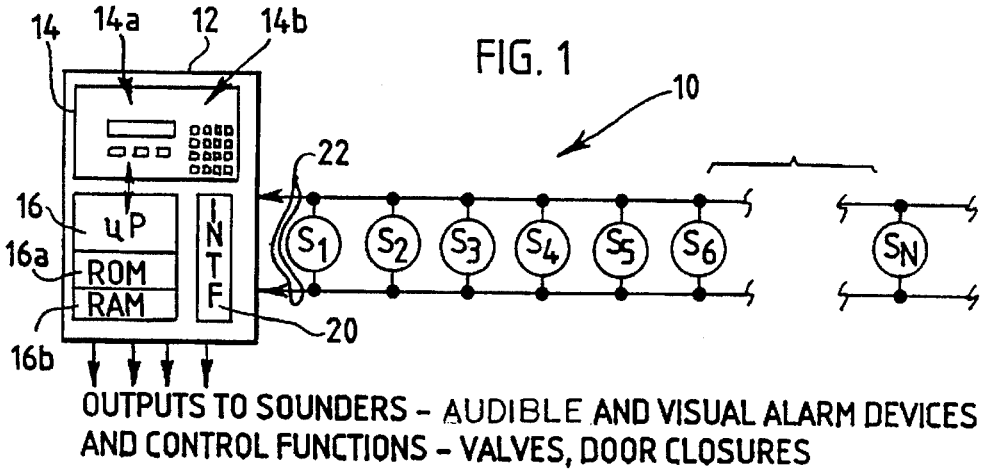
FIG. 1 is a block diagram of a fire alarm system in accordance with the present invention illustrating a series of sensing devices connected through a bi-directional electrical communication line to a control panel.

While this invention is capable of embodying many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

A representative known multiple detector alarm system is illustrated and described in Tice et al., U.S. Pat. No. 5,172,096 which is assigned to the assignee of the present invention. The disclosure and figures of the Tice et al. patent are incorporated herein by reference.

FIG. 1 illustrates a system 10 which embodies the present invention. The system 10 includes a control unit 12 with an input/output control panel 14. The control unit 12 further can include a programmable microprocessor 16 which includes read-only-memory (ROM) 16*a* and random-access-memory (RAM) 16*b*. A control program can be stored in the ROM memory 16*a*.

The microprocessor 16 is in bi-directional communication with the input/output control panel 14. In this regard, the panel 14 can include visual displays indicated generally at 14*a* as well as input devices, such as a keyboard, indicated generally at 14*b*.

The microprocessor 16 is in hi-directional communication with interface circuitry 20. The interface circuitry 20 is, in turn, in bi-directional communication with a communications link 22 which extends from the unit 12.

Coupled to the communications link 22, is a plurality of sensor units $S_1 \ldots S_n$. The sensor units could represent smoke detectors such as ionization-type smoke detectors or photoelectric-type smoke detectors. They could represent gas detectors, such as carbon monoxide detectors as well as heat detectors.

It will be understood that the exact structure of the detectors $S_1 \ldots S_n$ is not a limitation of the present invention. Similarly, it will be understood that neither the communication protocol nor the nature of the communication link 22, is a limitation of the present invention.

The microprocessor 16 via the interface circuitry 20 is in communication with and able to control audible and visual alarm devices such as horns or strobe lights used to indicate alarm conditions. Additionally, the microprocessor 16 is in communication with and able to control various types of control functions such as opening or closing valves in fire suppression systems, or causing the closure of previously unclosed fire doors.

Figure 2:
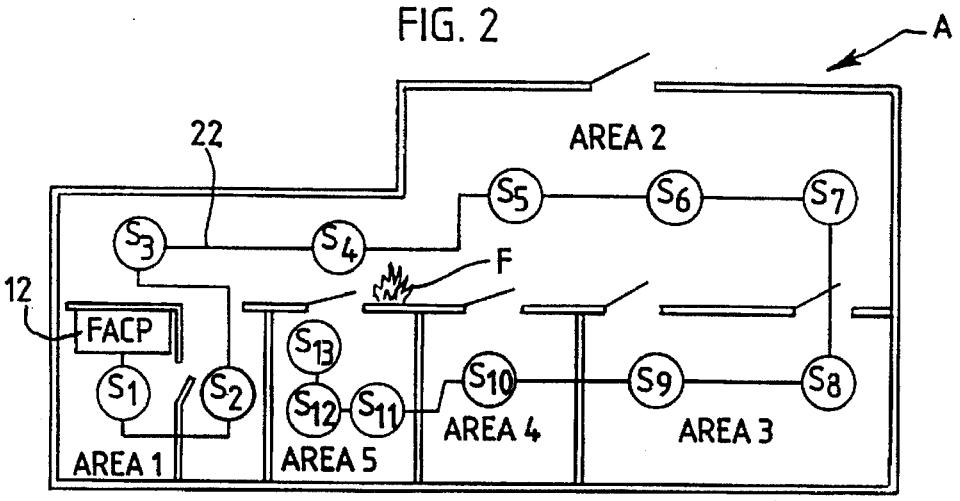
FIG. 2 illustrates an example of a building with the system of FIG. 1 installed, viewed from above. The sensors have addresses 1 through 13. A fire is shown near sensor 4. Note that in accordance with the system multiple sensors may be installed in a small room, area 5, which would normally only require one sensor. This may be done if the fire hazard is greater in this area, or if grater protection is desired in this area.

FIG. 2 illustrates the detectors $S_1 \ldots S_{13}$ arranged in an area A. The detectors illustrated in FIG. 2 are arranged in the area A with adjacent detectors having successive addresses arranged where possible in a common area. In this regard, detectors $S_3 \ldots S_7$ are arranged in area 2. Detectors $S_8$ and $S_9$ are arranged in area 3. Detectors $S_{11} \ldots S_{13}$ are arranged in area 5.

For purposes of carrying out an alarm determining method, the microprocessor 16 can communicate with each of the detectors $S_1 \ldots S_n$ on a sequential, polling, basis or can communicate with the detectors on a random basis. Each of the detectors $S_1 \ldots S_n$ is capable of returning to the control unit 12 a value which is indicative of an adjacent ambient condition, such as smoke or ambient temperature. These signals can be filtered using known techniques to remove both low and high frequency noise.

Figure 3:
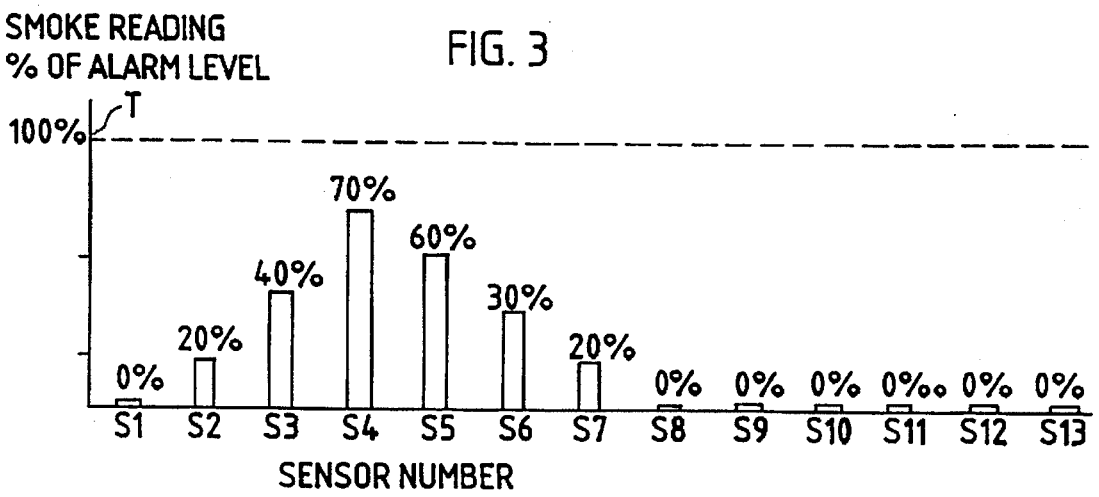
FIG. 3 is a graph which illustrates the hypothetical readings of the 13 individual sensors. The reading is greatest at sensor 4, but noticeable smoke is also present at sensors 2, 3, 5, 6 and 7.

FIG. 3 illustrates hypothetical readings from the detectors $S_1 \ldots S_{13}$ of FIG. 2. In view of the presence of an actual fire F adjacent to detector $S_4$ the output reading of detector $S_4$ at a selected time interval, as illustrated in FIG. 3, is greater than all of the other detectors but not sufficient to enter an alarm state. The alarm state is entered when a detector's output crosses an alarm level threshold T of FIG. 3.

In accordance with the method of the present invention, the microprocessor 16 raises the outputs of each of the detectors $S_1 \ldots S_n$ to a predetermined exponent, such as by squaring each value. In a subsequent method step, the processor 16 then combines the readings of a predetermined number of adjacent detectors, such as three or four detectors associated with a selected detector, such as $S_4$. The square root thereof is taken. This processed value is then associated with the selected detector, such as $S_4$.

That sum alternatively could be divided by the number of associated detectors in the group such as three or four.

Figure 4:
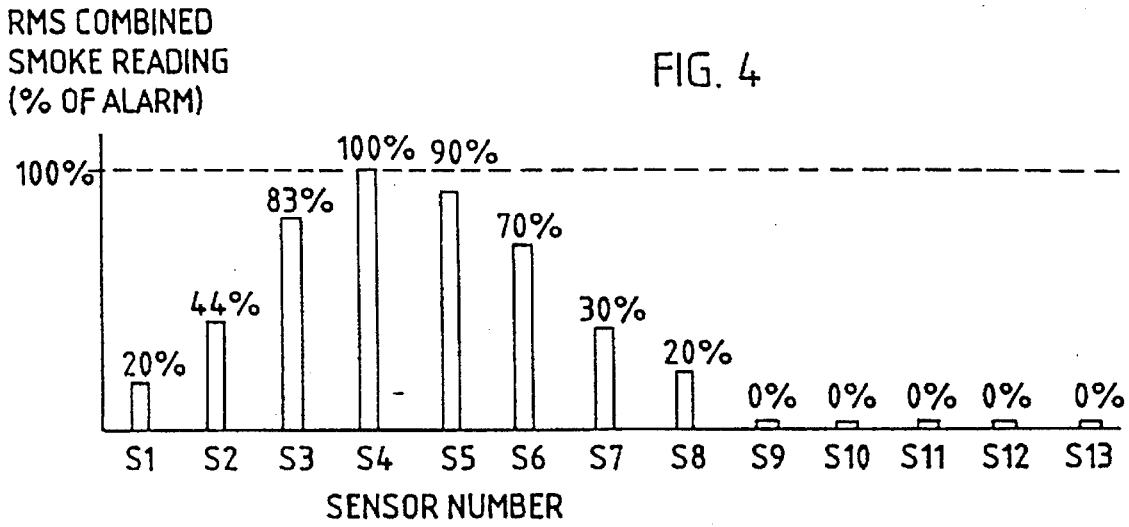
FIG. 4 is a graph which illustrates the results of an RMS calculation for each sensor when combined with adjacent sensors.

FIG. 4 illustrates processed detector values from FIG. 3 as a result of squaring the output values of each detector, combining the output values of each of two adjacent detectors with the third, that is to say, the output values for detectors $S_3$, $S_4$, $S_5$, have been squared, added together, and the square root thereof, taken. That value then becomes the processed value for detector $S_4$. Similar method steps are repeated for each of the detectors $S_2 \ldots S_{12}$.

As a result of the above-described method steps, detector $S_4$ now has associated therewith, a processed value corresponding to 100% of the alarm threshold T. In accordance with the present invention, microprocessor 16 would determine that a fire was present in the vicinity of the detector $S_4$ and would energize the audible and visual alarm devices associated therewith accordingly.

As illustrated in FIG. 4, the processed values for detectors $S_3$, $S_5$, and $S_6$ have all been increased as a result of the above-described method of processing the output values of FIG. 3. Hence, as illustrated in FIG. 4, those detectors closest to the fire condition F, will approach the alarm threshold T much faster when the outputs thereof are processed in accordance with the above-described method than when the outputs are merely processed for drift compensation and system noise.

Figure 5:
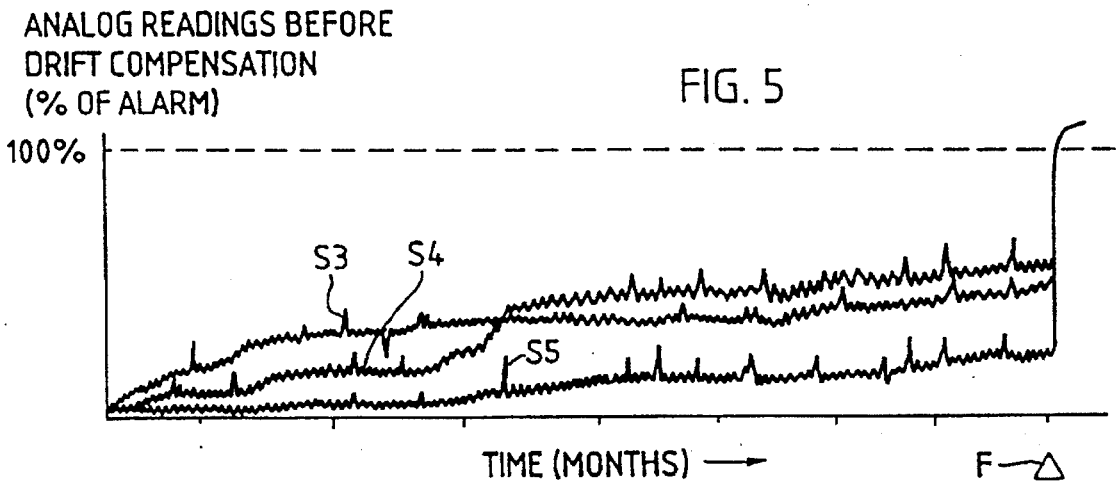
FIG. 5 is a graph which illustrates typical unprocessed readings from three sensors with a long term time scale, in months. The signals are affected by long term drift and by high frequency noise.
Figure 6:
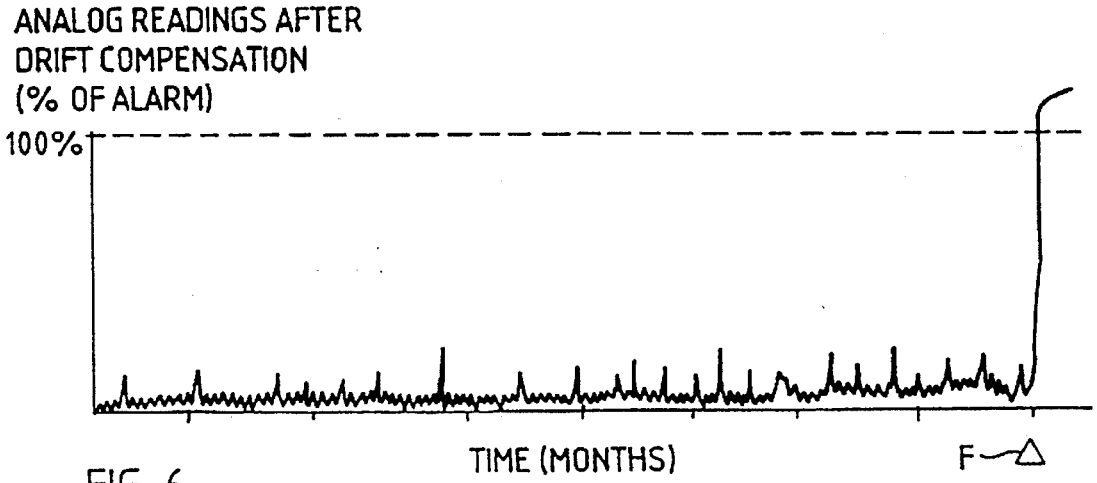
FIG. 6 is a graph which illustrates the same signals as FIG. 5, after they have been adjusted to compensate for the long term drift.

FIGS. 5 and 6 illustrate the outputs of detectors $S_3$, $S_4$ and $S_5$ over a period of time extending through several months up to the occurrence of the fire condition F. FIG. 5 illustrates outputs of the subject detectors without any drift compensation. FIG. 6 illustrates the same outputs after they have been processed by known drift compensation techniques.

Figure 7:
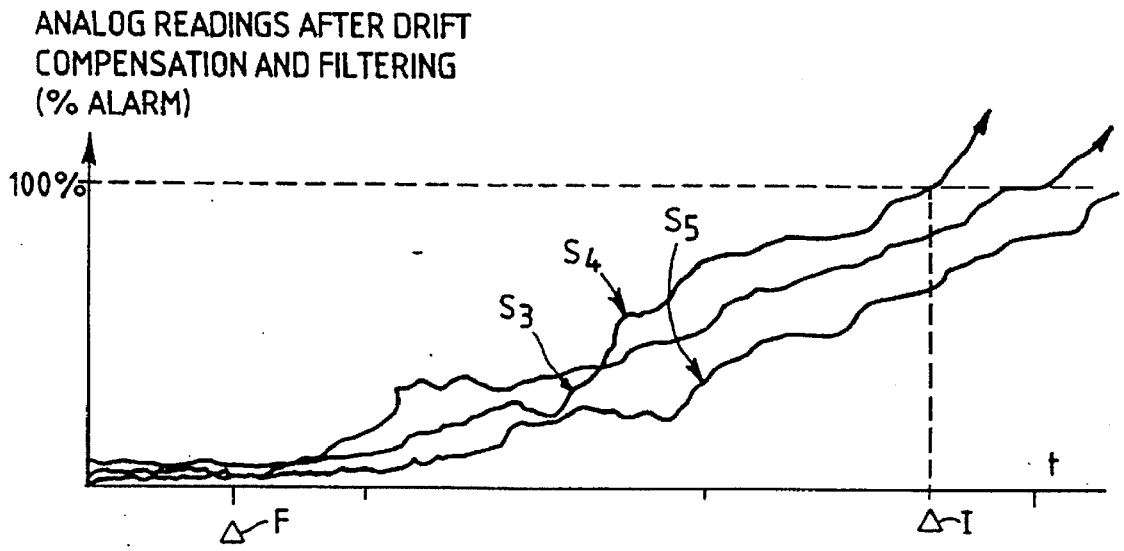
FIG. 7 is a graph which illustrates the same three signals, but on a much shorter time scale, and after they have been filtered by the panel software to remove higher frequency noise.

FIG. 7 illustrates processed outputs, compensated for drift as well as filtered for noise, of detectors, $S_3$, $S_4$ and $S_5$ as a function of time between the occurrence of the fire event F and the time of an alarm indication I. As illustrated in FIG. 7, outputs of the detectors $S_3$, $S_4$ and $S_5$ rapidly increase in response to the fire event F. The output of detector $S_4$, being closest to the fire condition F crosses the alarm condition threshold T first followed by outputs from detector $S_3$ and $S_5$.

Figure 8:
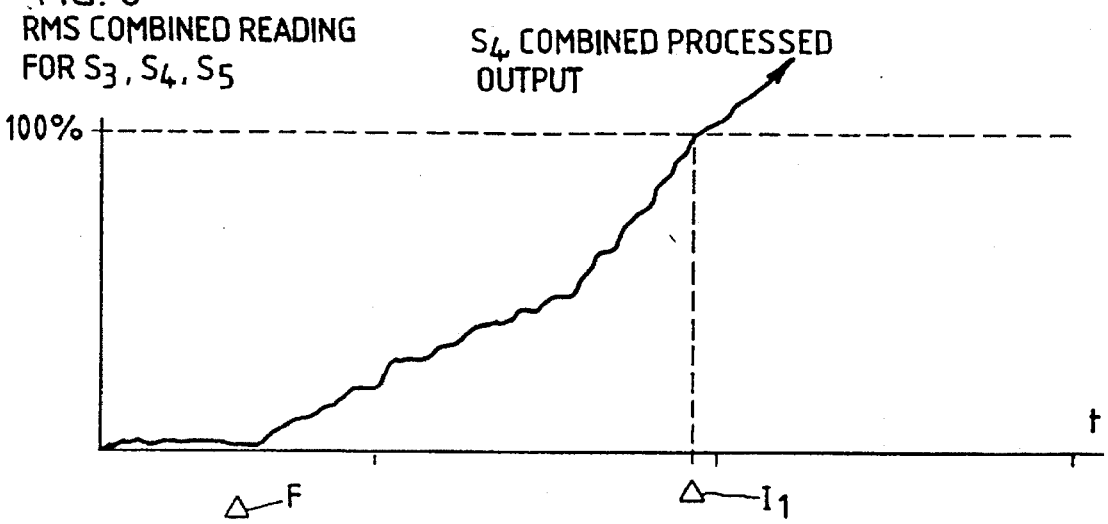
FIG. 8 is a graph which illustrates the three signals combined into one RMS reading. Note that the alarm indication occurs earlier in time than in FIG. 7.

FIG. 8 illustrates the improvement brought about by the system 10 described previously. In FIG. 8 the processed output of detector $S_4$ is illustrated.

Consistent with the graph of FIG. 4, the output value from detector $S_4$ when processed in combination with the output values of detectors $S_3$ and $S_5$, crosses the alarm threshold T, at time I1 sooner than does the output of detector $S_4$, as illustrated in FIG. 7, which does not have the benefit of additional inputs from detectors $S_3$ and $S_5$. Thus, the system 10 is able to make an alarm determination sooner as a result of the RMS processing described previously than if such cooperative processing does not take place.

It will be understood that exponential values other than the integer value of 2 could be used in the processing without departing from the scope and spirit of the present invention. In such instances, a corresponding root would be formed based on the exponential value used for such processing. Additionally, more than two adjacent cooperative detectors could be incorporated into a determination of a processed sensor output value without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An ambient condition detection apparatus comprising:

a plurality of separate, spaced apart detectors wherein said detectors provide indicia of respective, sensed, ambient conditions;

a control unit;

a communications link wherein said detectors are in bi-directional communication with said control unit, wherein said unit receives indicia therefrom indicative of the respective, sensed ambient conditions, wherein said unit includes circuitry for processing selected, predetermined groups of indicia, wherein at least one of the groups overlaps another one of the groups, wherein each said group is associated with a selected member thereof, wherein the members of said group are located physically adjacent to at least one other member of said group and wherein said processing circuitry raises each indicium in a group to a first exponent, having a value greater that one, forms of a summed total of the exponentially raised indicia of each member of said group and raises said total to a second exponent having a value less than one thereby providing a processed value for said selected member corresponding to ambient conditions sensed by said detectors of said group.

2. An apparatus as in claim 1 wherein said unit includes circuitry for comparing said processed value to a predetermined value to establish the existence of an alarm condition.

3. An apparatus as in claim 1 wherein each detector of a group has an associated address and wherein said addresses are indicative of a physical arrangement of said members of said group relative to one another.

4. An apparatus as in claim 3 wherein said respective addresses are assigned sequentially within said group.

5. An apparatus as in claim 1 wherein said unit includes circuitry for squaring each said indicium in a said group.

6. An apparatus as in claim 1 wherein said unit includes circuitry for forming a square root of said summed total.

7. An apparatus as in claim 1 wherein at least some of said detectors include first and second different sensors.

8. An apparatus as in claim 7 wherein at least some of said first and second different sensor pairs are intended to detect a fire condition.

9. An apparatus as in claim 1 wherein at least some of said detectors sense different ambient conditions than do others.

10. A method of operating an alarm system which includes a plurality of separate fire detectors which are in bidirectional communication with a control unit, wherein the detectors are installed, in a region to be supervised, the method comprising:

establishing at least first and second groups of detectors which are located in a selected area within the region such that each detector of each group is located adjacent to but displaced from at least one other member of the respective group and wherein at least one of the detectors is in both of the groups;

determining, at the control unit, a signal value from each detector of each of the groups wherein the signal values are each indicative of a respective, detected, ambient, fire condition at each detector;

forming a processed fire related value for at least a selected detector of each of the groups by squaring each signal value for each detector the group and adding the squared value for each detector in the group to a squared value for each adjacent detector of the group and forming a square root thereof thereby creating a processed fire value for the selected detector of the group;

comparing the processed fire values to a predetermined threshold value; and repeating the above steps to form processed fire values for each detector of each group.

11. A method as in claim 10 wherein each detector has an associated address and including sequentially assigning addresses in a group.

12. A method as in claim 11 which includes processing the signal values to reduce noise variations thereon.

13. A method as in claim 10 wherein in the establishing step, each member of a respective group detects the same type of fire condition.

* * * * *